US009127533B2

(12) United States Patent
Hallundbæk et al.

(10) Patent No.: US 9,127,533 B2
(45) Date of Patent: Sep. 8, 2015

(54) WELL COMPLETION

(75) Inventors: Jorgen Hallundbæk, Græsted (DK); Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 49 days.

(21) Appl. No.: 13/878,639

(22) PCT Filed: Dec. 16, 2011

(86) PCT No.: PCT/EP2011/073104

§ 371 (c)(1),
(2), (4) Date: May 17, 2013

(87) PCT Pub. No.: WO2012/080490

PCT Pub. Date: Jun. 21, 2012

(65) Prior Publication Data

US 2013/0319677 A1 Dec. 5, 2013

(30) Foreign Application Priority Data

Dec. 17, 2010 (EP) ..... 10195813

(51) Int. Cl.
*E21B 23/00* (2006.01)
*E21B 43/26* (2006.01)
(Continued)

(52) U.S. Cl.
CPC ..... *E21B 43/101* (2013.01); *E21B 17/00* (2013.01); *E21B 33/1285* (2013.01); *E21B 43/103* (2013.01)

(58) Field of Classification Search
CPC ..... E21B 23/06; E21B 33/124; E21B 43/103; E21B 43/12; E21B 33/127; E21B 33/1285; E21B 34/10; E21B 33/1208; E21B 33/1243; E21B 33/1246; E21B 33/1272; E21B 17/00
USPC ..... 166/206, 207, 217, 120, 216, 387, 166/308.1, 382, 193
See application file for complete search history.

(56) References Cited

U.S. PATENT DOCUMENTS 2,970,651 A * 2/1961 Roberts ..... 166/212
3,606,924 A * 9/1971 Malone ..... 166/187
(Continued)

FOREIGN PATENT DOCUMENTS

EP 2 206 879 7/2010
WO WO 2007/031723 A2 3/2007
(Continued)

OTHER PUBLICATIONS

International Search Report for PCT/EP2011/073104 mailed Feb. 21, 2012.
(Continued)

*Primary Examiner* — Kenneth L Thompson
*Assistant Examiner* — Michael Willis, III
(74) *Attorney, Agent, or Firm* — Nixon & Vanderhye P.C.

(57) ABSTRACT

The present invention relates to a completion assembly for running into a borehole in a formation through a well head or blowout preventer, comprising a casing string having a first end and a second end, and a drill pipe having a first end and a second end and extending through the well head or the blowout preventer and being releasably connected at the first end with the casing string. Furthermore, the invention relates to a completion method for completing a casing string. Moreover, the invention relates to a completion kit for making a completion assembly according to the present invention.

17 Claims, 14 Drawing Sheets

(51) Int. Cl.

| | |
|---|---|
| ***E21B 43/10*** | (2006.01) |
| ***E21B 33/128*** | (2006.01) |
| ***E21B 17/00*** | (2006.01) |

(56) References Cited

U.S. PATENT DOCUMENTS

| | | | | |
|---|---|---|---|---|
| 4,349,204 | A * | 9/1982 | Malone | 277/334 |
| 4,499,947 | A * | 2/1985 | Zsoka et al. | 166/179 |
| 4,756,364 | A * | 7/1988 | Christensen et al. | 166/101 |
| 4,913,232 | A | 4/1990 | Cheymol et al. | |
| 4,962,815 | A * | 10/1990 | Schultz et al. | 166/387 |
| 5,174,379 | A * | 12/1992 | Whiteley et al. | 166/278 |
| 5,375,662 | A * | 12/1994 | Echols et al. | 166/386 |
| 6,530,574 | B1 | 3/2003 | Bailey et al. | |
| 6,640,893 | B1 | 11/2003 | Rummel et al. | |
| 7,066,264 | B2 * | 6/2006 | Bissonnette et al. | 166/305.1 |
| 7,584,796 | B2 * | 9/2009 | Ayling | 166/358 |
| 8,584,758 | B2 * | 11/2013 | Radmanovich et al. | 166/308.1 |
| 2003/0121670 | A1 * | 7/2003 | Dolyniuk et al. | 166/387 |
| 2004/0000406 | A1 | 1/2004 | Allamon et al. | |
| 2004/0055758 | A1 | 3/2004 | Brezinski et al. | |
| 2005/0061508 | A1 | 3/2005 | Surjaatmadja | |
| 2005/0098324 | A1 | 5/2005 | Gano | |
| 2005/0161232 | A1 | 7/2005 | Patel et al. | |
| 2006/0124310 | A1 | 6/2006 | Lopez de Cardenas et al. | |
| 2007/0029082 | A1 | 2/2007 | Giroux et al. | |
| 2009/0211769 | A1 * | 8/2009 | Assal | 166/387 |
| 2009/0283279 | A1 * | 11/2009 | Patel et al. | 166/382 |
| 2009/0294137 | A1 * | 12/2009 | Meijer | 166/387 |
| 2010/0000727 | A1 * | 1/2010 | Webb et al. | 166/135 |
| 2011/0100643 | A1 * | 5/2011 | Themig et al. | 166/373 |
| 2011/0266004 | A1 * | 11/2011 | Hallundbaek et al. | 166/369 |
| 2012/0097398 | A1 * | 4/2012 | Ravensbergen et al. | 166/308.1 |
| 2012/0199339 | A1 * | 8/2012 | Hallundbæk et al. | 166/134 |
| 2014/0311751 | A1 * | 10/2014 | Hallundb k et al. | 166/369 |

FOREIGN PATENT DOCUMENTS

| | | |
|---|---|---|
| WO | WO 2009/120759 A2 | 10/2009 |
| WO | WO 2010/136806 A2 | 12/2010 |

OTHER PUBLICATIONS

Written Opinion of the International Searching Authority mailed Feb. 21, 2012.

International Preliminary Report on Patentability issued in International Application No. PCT/EP2011/073104 dated Jun. 18, 2013.

Communication of a Notice of Opposition mailed Mar. 3, 2014 in European Patent No. 2 466 065, Opponent: Saltel Industries, 12 pages.

Communication of a Notice of Opposition mailed Mar. 6, 2014 in European Patent No. 2 466 065, Opponent: Rex Martin Vinsome, 24 pages.

Patent Examination Report No. 1 mailed Aug. 14, 2014 in Australian Application No. 2011343208, 3 pages.

Dreesen, Donald S., "Analytical and Experimental Evaluation of Expanded Metal Packers for Well Completion Service," SPE Society of Petroleum Engineers, SPE 22858, presented Oct. 6-9, 1991 at the 66$^{th}$ Annual Technical Conference and Exhibition of the Society of Petroleum Engineers, pp. 413-421.

TAM Intervention Scab Liner Systems, ISO 9001 2000, Tam International Inflatable and Swellable Packers, 4 pages.

* cited by examiner

WELL COMPLETION

This application is the U.S. national phase of International Application No. PCT/EP2011/073104 filed 16 Dec. 2011 which designated the U.S. and claims priority to EP 10195813.0 filed 17 Dec. 2010, the entire contents of each of which are hereby incorporated by reference.

FIELD OF THE INVENTION

The present invention relates to a completion assembly for running into a borehole in a formation through a well head or blowout preventer, comprising a casing string and a drill pipe. Furthermore, the invention relates to a completion method for completing a casing string. Moreover, the invention relates to a completion kit for making a completion assembly according to the present invention.

BACKGROUND ART

Operations such as well completion are very cost-intensive due the material costs, the labour costs, the safety requirements and the rental costs for renting a drilling rig. Drilling rigs are very expensive to rent per day, and in the past there have been several attempts to develop an improved completion element to make the completion easier and thus faster to implement. Also, attempts to improve the completion equipment have been made in order to make implementation of the existing completion elements faster.

Despite the known improvements, there is a continued focus on reducing costs and especially on reducing the number of days during which the drilling rig is required.

SUMMARY OF THE INVENTION

It is an object of the present invention to wholly or partly overcome the above disadvantages and drawbacks of the prior art. More specifically, it is an object to provide an improved completion assembly for running into a borehole, which is faster to complete than the known completions, while still complying with the safety requirements.

The above objects, together with numerous other objects, advantages, and features, which will become evident from the below description, are accomplished by a solution in accordance with the present invention by a completion assembly for running into a borehole in a formation through or from a well head or blowout preventer, comprising:

a casing string having a first end, and a drill pipe having a first end and a second end and extending through the well head or the blowout preventer and being releasably connected at the first end with the casing string and thereby holding the casing string when running the casing string into the borehole, wherein the casing string comprises:

a plurality of tubular sections, at least two sections being annular barrier sections each comprising at least one annular barrier, the annular barriers being arranged at a predetermined mutual distance, each annular barrier comprising an expandable sleeve surrounding a tubular part and the expandable sleeve is connected with the tubular part, the tubular part forming part of the casing string and having an opening for entry of pressurised fluid to expand the sleeve, and a second end which is closed, wherein the completion assembly further comprises a pressure creating device fluidly connected with the second end of the drill pipe generating a fluid pressure within the drill pipe and within the casing string which is substantially greater than a formation fluid pressure for expanding the expandable sleeve of the at least two annular barrier sections.

By being able to expand the annular barrier during operation and by expanding the expandable sleeves of the barriers substantially simultaneously, the completion operation can occur much quicker than in the known completion assemblies. It is thus obtained that the expensive drilling rig can be disconnected from the completion site, and a less expensive rig can replace the drill rig. By cutting the number of days during which the expensive drilling rig is required, the cost of making a well is substantially reduced. A drilling rig is rented by the day, and the present invention reduces the number of days during which the expensive drilling rig is required by at least 10-15.

In one embodiment, the completion assembly for running into a borehole in a formation through a well head or blowout preventer may comprise:

a casing string having a first end, and a running tool extending through the well head or the blowout preventer and being releasably connected with the first end of the casing string and thereby holding the casing string when running the casing string into the borehole, wherein the casing string comprises:

a plurality of tubular sections, at least two sections being annular barrier sections each comprising at least one annular barrier, the annular barriers being arranged at a predetermined mutual distance, each annular barrier comprising an expandable sleeve surrounding a tubular part and the expandable sleeve is connected with the tubular part, the tubular part forming part of the casing string and having an opening for entry of pressurised fluid to expand the sleeve, and a second end which is closed, wherein the completion assembly further comprises a pressure creating device fluidly connected with the running tool generating a fluid pressure within the casing string which is substantially greater than a formation fluid pressure for expanding the expandable sleeve of the at least two annular barrier sections.

By using a running tool, the casing may be a surface casing and the expansion of the expandable sleeves of the barriers substantially simultaneously is still possible, so that the completion operation can occur much quicker than in the known completion assemblies.

The expandable sleeves may be expanded substantially simultaneously when pressurising the casing string from within.

Moreover, the drill pipe may be releasably connected with the casing string by means of a running tool.

Further, the drill pipe may have an overall outer diameter which is smaller than that of the casing string.

In one embodiment, one of the tubular sections may be an inflow control section having a tubular part.

Also, one of the inflow control sections may be a valve section having inflow control valves.

Furthermore, the inflow control section may be arranged between the annular barrier sections.

In addition, the inflow control section may comprise a fracturing valve.

Moreover, the inflow control section may comprise an inflow control valve arranged in the tubular part.

In addition, a sleeve may be arranged to slide or rotate between an open position opposite a fracturing opening of the fracturing valve and a closed position or a choked position.

In another embodiment, the completion assembly may further comprise a sleeve slidable axially of the casing string opposite the inflow control section to seal off the inflow control section when the expandable sleeves are expanded.

Moreover, the completion assembly as described above may comprise a sleeve slidable axially of the casing string or rotationally within the casing string opposite the inflow control section.

By having sliding sleeves capable of closing the inflow control section, and thus preventing the pressurised fluid within the casing string from flowing out through the inflow control valve or opening, the expandable sleeves can be expanded during operation even though the casing string comprises inflow control valves or openings in the inflow control section.

Furthermore, the tubular part may have an inner face and the sleeve may have an outer face facing the inner face of the tubular part, and the sleeve may comprise sealing elements arranged in grooves in the outer face of the sleeve.

Moreover, the inflow control section may have an inflow section with at least one opening having a width $w_o$ in the axial extension, and the sealing element may have a width $w_s$ which is larger than a width $w_o$ of the opening.

The sealing elements may be O-rings, Chevron seals, or similar seals.

Also, one of the tubular sections may be a section containing only the tubular part.

One of the tubular sections may comprise a fixation device for anchoring the casing string to the formation.

The fixation device may comprise a tubular part and a fixation unit projecting from the tubular part towards the formation when activated by a fluid pressure from within the casing string.

Said fixation device may comprise a tubular part and a fixation unit projecting from the tubular part towards the formation when activated by an electrical motor, a force generator, an operational tool or similar means from within the casing string.

Further, the fixation device may be an annular barrier comprising a fixation element projecting from the expandable sleeve towards the formation when activated by a fluid pressure from within the casing string.

Moreover, the annular barrier may comprise a valve arranged in the opening, and the casing string may comprise means for closing the second end.

Additionally, the means for closing the second end may be a ball dropped into a seat in the second end of the casing string.

The present invention further relates to a completion method for completing a casing string as described above, comprising the steps of:

- mounting at a rig or vessel tubular sections into a first part of a casing string,
- lowering the first part of the casing string towards the borehole,
- mounting tubular sections into a second part of the casing string,
- connecting the second part of the casing string with the first part,
- lowering the second part of the casing along with the first part,
- connecting a drill pipe to the casing string and thus holding the casing string when lowering the casing string into the borehole, wherein the casing string comprises at least two annular barrier sections,
- lowering the drill pipe into the borehole until the casing string is arranged in a predetermined position,
- pressurising the drill pipe and the casing string, and
- substantially simultaneously expanding an expandable sleeve of an annular barrier of each of the annular barrier sections.

The completion method may further comprise disconnecting the drill pipe.

It is hereby obtained that the expensive drill rig can be disconnected from the completion site and a less expensive rig can replace the drill rig.

In addition, the completion method may further comprise the step of lowering a production casing into the borehole.

Moreover, the completion method may further comprise the step of fastening the production casing to the casing string.

The fastening of the production casing may be performed by inflating a packer around the production casing.

Further, the completion method may comprise the step of connecting an inflow control section to the casing string.

Also, the completion method may further comprise the steps of connecting a fixation device to the casing string and activating the fixation unit of the fixation device in the borehole, wherein the step of activating the fixation unit may take place substantially simultaneously with the step of expanding the expandable sleeve.

And the completion method may further comprise the steps of opening a fracturing valve, and fracturing the formation by means of a pressurised fluid from within the casing string in order to make fractures in the formation.

Moreover, the completion method may further comprise the step of closing the fracturing sleeve.

Additionally, the completion method may further comprise the step of sliding a sliding sleeve in an axial direction, hence activating the inflow control section.

The completion method as described above may further comprise the steps of producing hydrocarbon containing fluid from the formation through the inflow valves of the valve or inflow control section.

Furthermore, the completion method may further comprise the step of hydrocarbon containing fluid flowing through the casing string.

The parts of a casing string may each comprise at least three tubular sections.

Moreover, the present invention relates to a completion kit for making a completion assembly as described above, comprising a container comprising:

- a plurality of tubular sections in the form of annular barrier sections, and
- a plurality of tubular sections in the form of inflow control sections.

The container may comprise at least one fixation device.

Further, the container may comprise a plurality of tubular sections containing only a tubular part.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
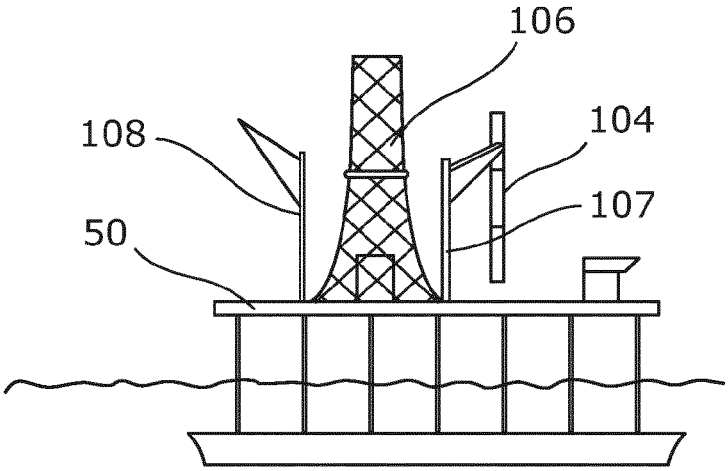
FIG. 1 shows a drill rig after drilling a borehole with the BOP in place, and when mounting a first part of the casing string from tubular sections.
Figure 1:
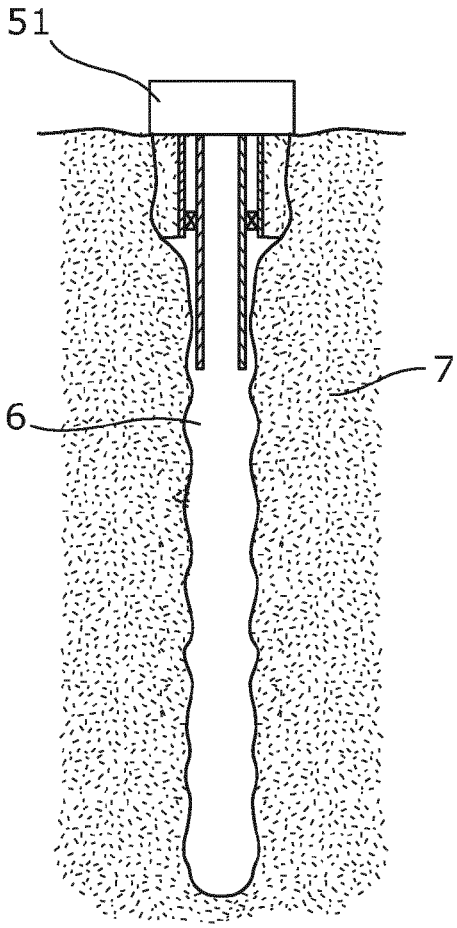
Figure 2:
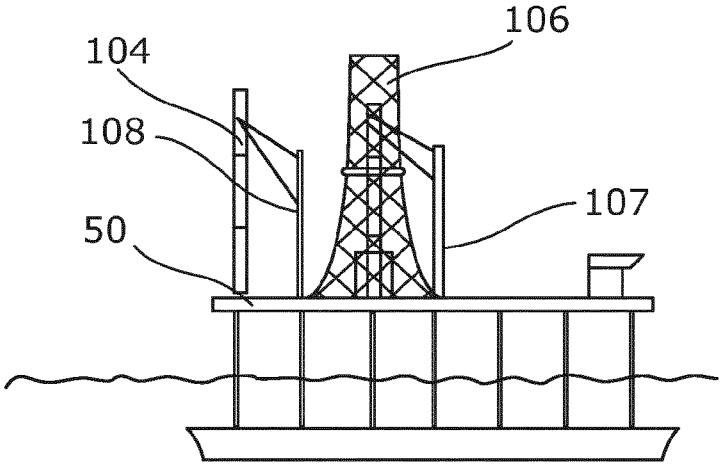
FIG. 2 shows the first part of the casing string arranged in the tower before it is lowered into the borehole while mounting a second part of the casing string.
Figure 2:
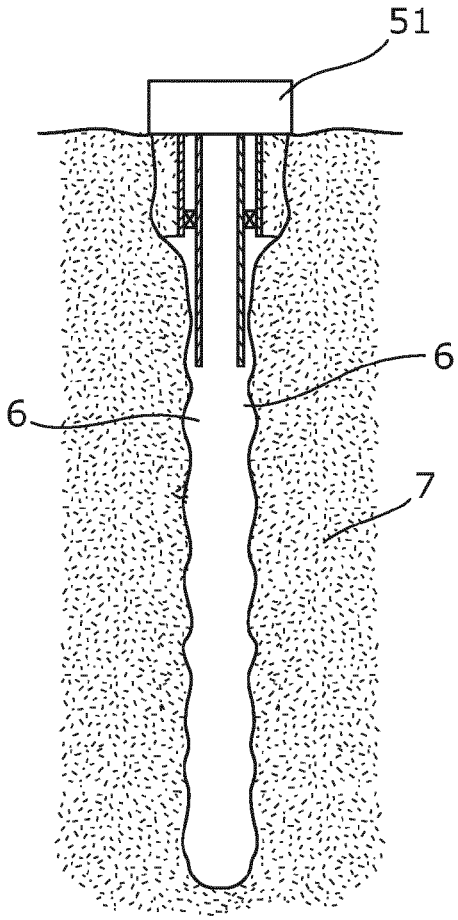

FIG. 1 shows a drill rig 50 after drilling a borehole 6 in a formation 7 and after insertion of a Blow Out Preventer (BOP) 51 or a well head 51. On the rig, three tubular sections 101 have been assembled into one casing part in a first crane 107. When three tubular sections 101 have been mounted into a first part of a casing string 104, the first crane 107 moves the first part into the derrick 106, while three other tubular sections 101 are mounted into a second part of the casing string 104 in a second crane 108, as shown in FIG. 2.

Figure 3:
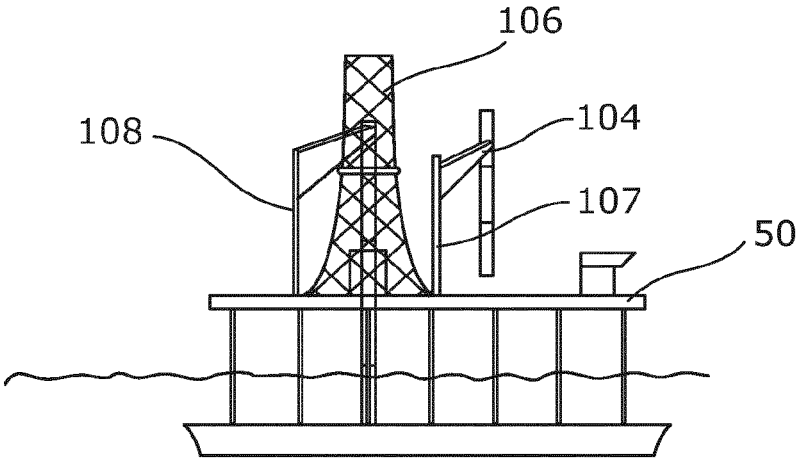
FIG. 3 shows the second part of the casing string being connected to the first part, while a third part of the casing string is mounted.
Figure 3:
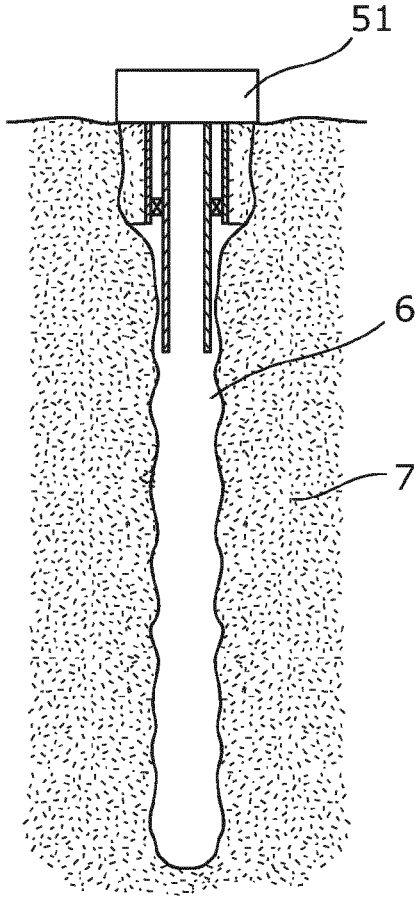

Subsequently, the second crane 108 moves the second part of the casing string 104 into the derrick 106, and the second part of the casing string 104 is assembled with the first part of the casing string 104. While assembling the first part with the second part, a third part is mounted from three tubular sections 101 as shown in FIG. 3. This process is repeated until the casing string 104 comprises the tubular sections 101 as planned.

Figure 4:
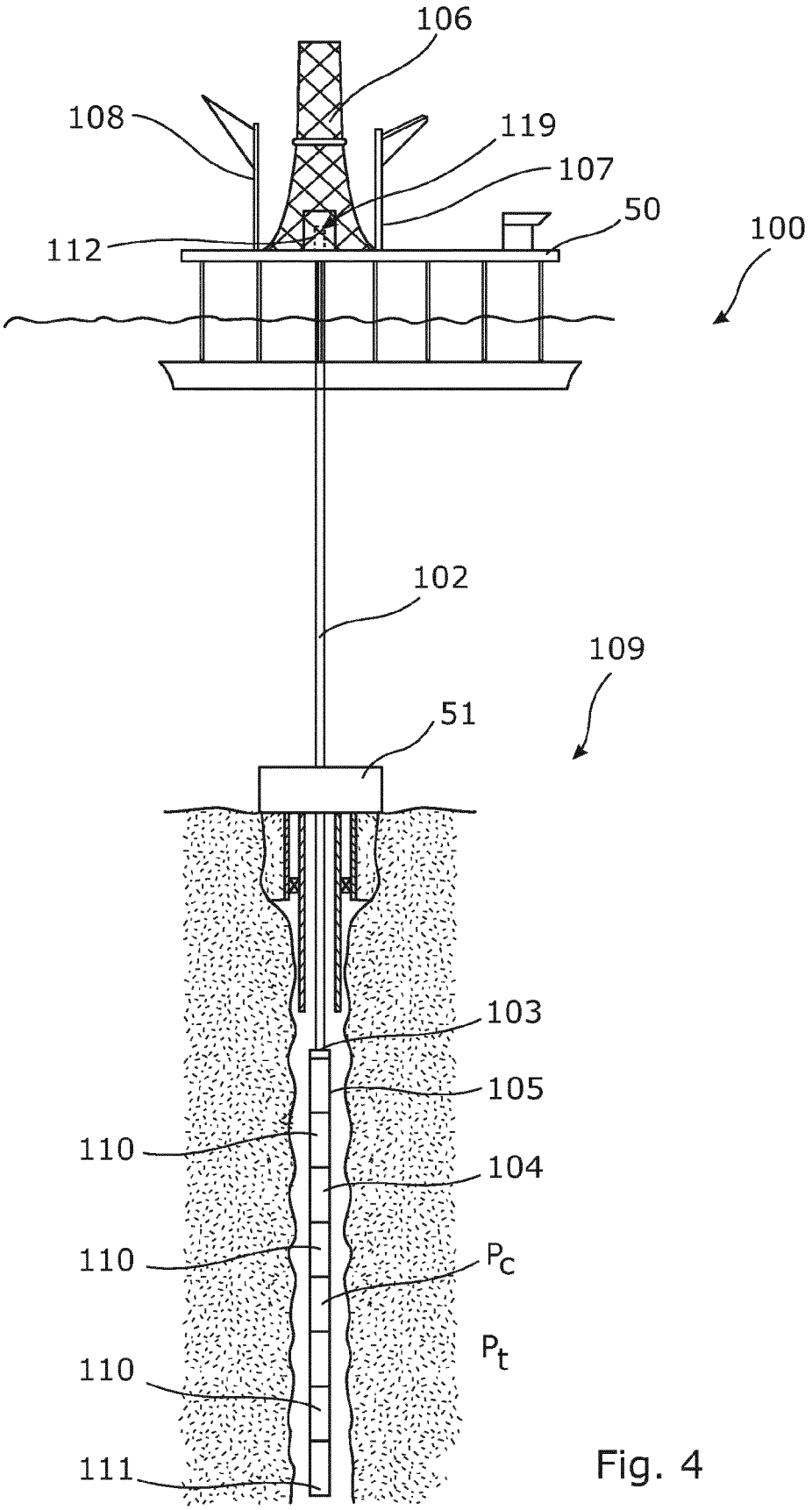
FIG. 4 shows the parts of the casing string being lowered into the borehole.

In FIG. 4, the casing string 104 is mounted with all its tubular sections 101. The casing is connected in its first end 105 with the first end 103 of a drill pipe 102 holding the casing string in order to submerge the casing string 104 into the well 109 thus forming a completion assembly 100. When the completion assembly 100 is arranged in a predetermined position in the borehole 6, the drill pipe 102 is pressurised from the rig in order to fasten the casing string 104 in the borehole 6. In another embodiment, the rig could be a vessel.

The casing string 104 comprises a plurality of tubular sections 101, at least two sections being annular barrier sections 110 each comprising at least one annular barrier. The annular barriers are arranged at a predetermined mutual distance, and each annular barrier comprises an expandable sleeve 116 surrounding a tubular part 4, the tubular part 4 forming part of the casing string 104 and having an opening 118 for the entry of pressurised fluid to expand the sleeve. The casing string 104 is closed at its second end 111. For pressurising the drill pipe 102, the completion assembly 100 comprises a pressure creating device 119 connected with a second end 112 of the drill pipe 102, generating a casing fluid pressure within the drill pipe 102 and within the casing string 104. The pressure creating device 119 is thus arranged above the well head, preferably at the rig or vessel. In order to expand the expandable sleeve 116 of the annular barriers, the casing fluid pressure Pc within the drill pipe 102 is substantially greater than a formation fluid pressure Pf. In this way, the expandable sleeves 116 are expanded in one operation and substantially simultaneously. The second end 111 of the casing string 104 may be closed by dropping a ball down the drill pipe 102 so that the ball drops down and is fastened to a seat in the second end 111 of the casing string 104.

By being able to expand the annular barrier during operation and by expanding the expandable sleeves 116 of the barriers substantially simultaneously, the completion operation can occur much quicker than in the known completion assemblies. It is thus obtained that the expensive drilling rig can be disconnected from the completion site, and a less expensive rig can replace the drill rig. By cutting the number of days during which the expensive drilling rig is required, the cost of making a well is substantially reduced. A drilling rig is rented by the day, and the present invention reduces the number of days during which the expensive drilling rig is required by at least 10-15.

Figure 5:
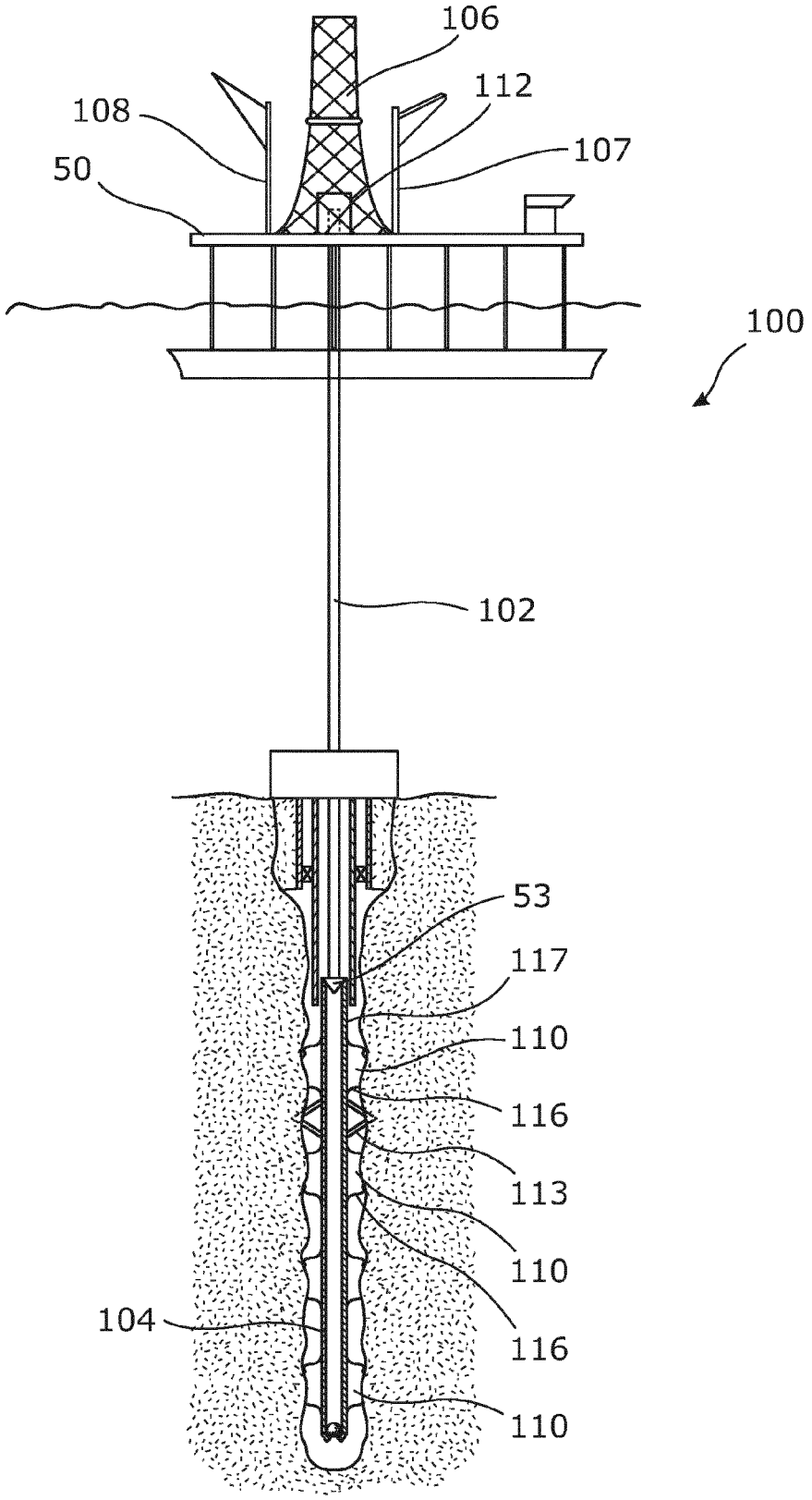
FIG. 5 shows the casing string when the annular barriers have expanded and rock anchor has been activated.

As can be seen from FIG. 5, the drill pipe has a smaller overall outer diameter than an overall outer diameter of the casing string, and the drill pipe is releasably connected with the casing string, preferably by means of a running tool 53.

The completion assembly 100 further comprises tubular sections 101 having a fixation device 113 for anchoring the casing string 104 to the formation 7. In FIG. 5, the drill pipe 102 and the casing string 104 have been pressurised and the annular barrier and the fixation devices 113 have been expanded. The expandable sleeve 116 of the annular barrier is expanded until it presses against the inner surface of the borehole 6 in order to isolate a production zone. The fixation devices 113 or rock anchors are expanded until they are firmly anchored into the formation 7 and this is carried out in the same operation as the expansion of the sleeve of the annular barriers and substantially simultaneously with the expansion of the sleeves. The fixation device 113 comprises a tubular part 4 and a fixation unit projecting from the tubular part towards the formation 7 when activated by a fluid pressure from within the casing string 104. The purpose of the rock anchors is to fixate the casing string 104 in its axial direction so that the isolation properties of the annular barriers are not destroyed during the expansion of the annular barriers and/or during the production of hydrocarbons.

Figure 6:
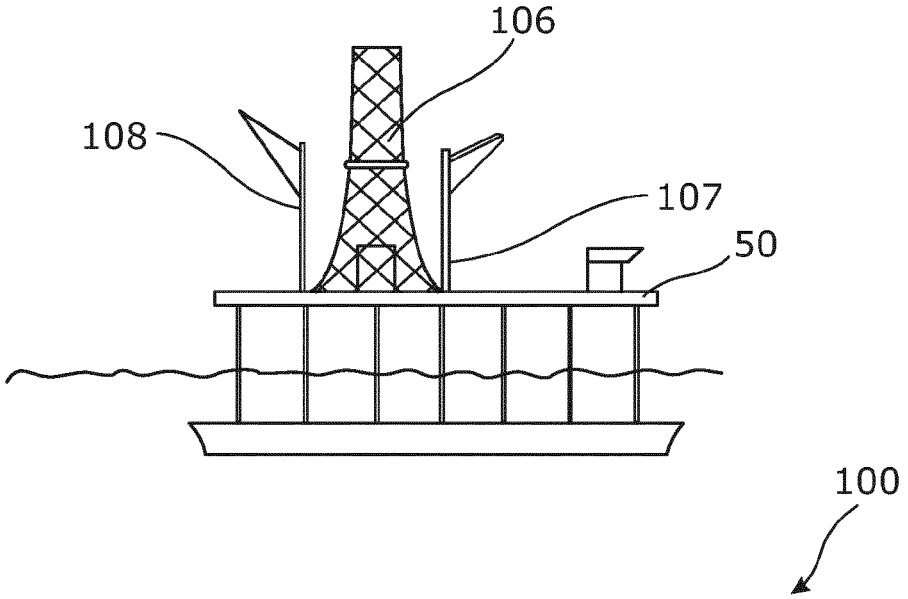
FIG. 6 shows the casing string in the borehole and the drill pipe disconnected.
Figure 6:
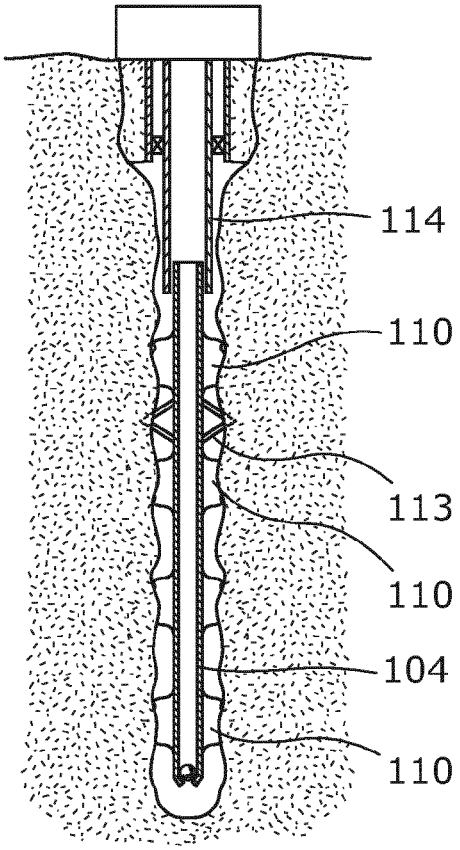
Figure 7:
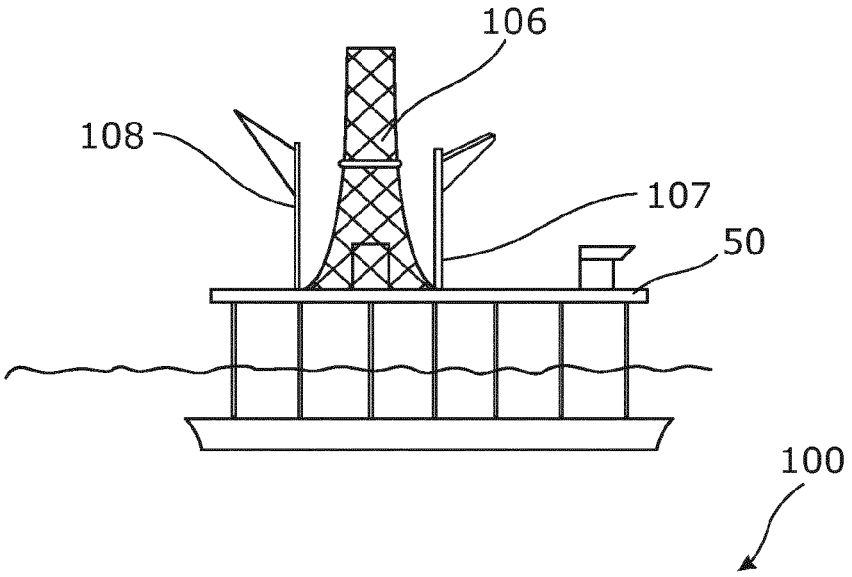
FIG. 7 shows a completed well with the casing string and a conductor casing.
Figure 7:
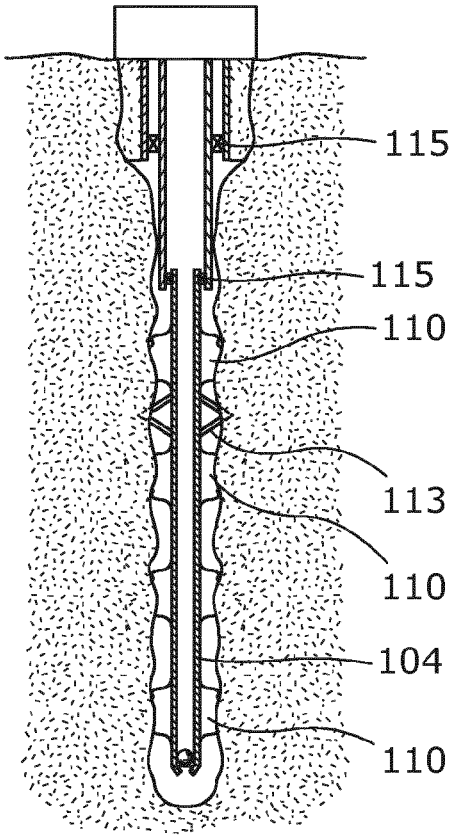

When the annular barriers and the rock anchors have been expanded, the drill pipe 102 is disconnected from the casing string 104 and leaves the casing string 104 in the borehole 6 as shown in FIG. 6. A packer 115 is set between the production casing 114 and the casing string 104 in order to make a second barrier as shown in FIG. 7.

Figure 8:
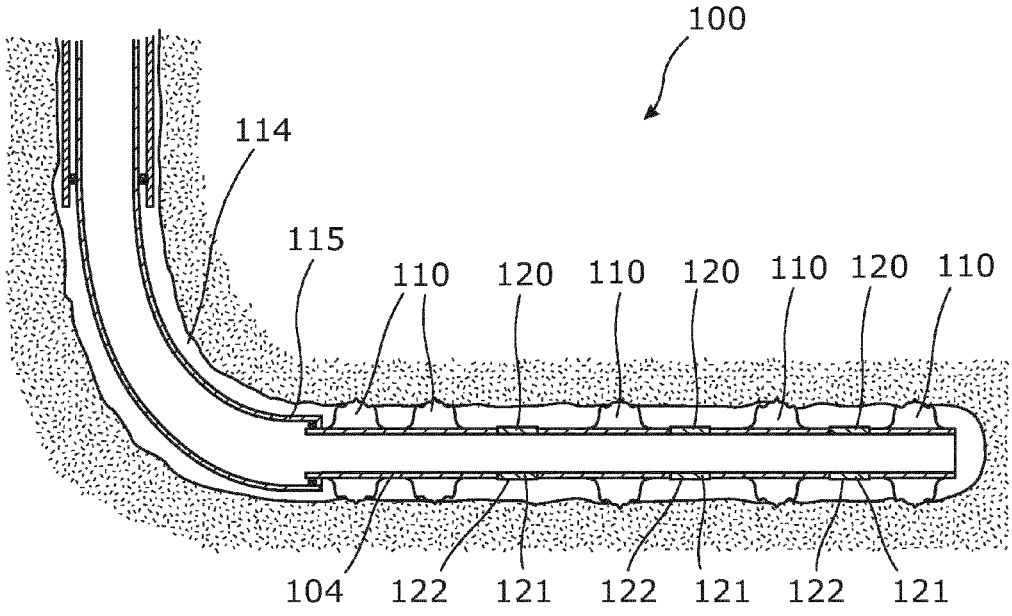
FIG. 8 shows a horizontal completion.

In FIGS. 1-7, the completion assembly 100 is described running into a vertical well, and in FIG. 8, the completion assembly 100 is shown in a horizontal well in which the casing string 104 comprises several annular barrier sections 110. The casing string 104 is subsequently connected with a production casing 114 by means of a packer 115 or chevron seals. The casing string 104 is inserted into the borehole 6 by means of a drill string, and when arranged in the predetermined position, the drill pipe 102 and the casing string 104 is pressurised from within by means of the pressure creating device 119 arranged at the second end 112 of the drill pipe 102. Hereby, the annular barriers are expanded in one operation and substantially simultaneously.

Figure 9:
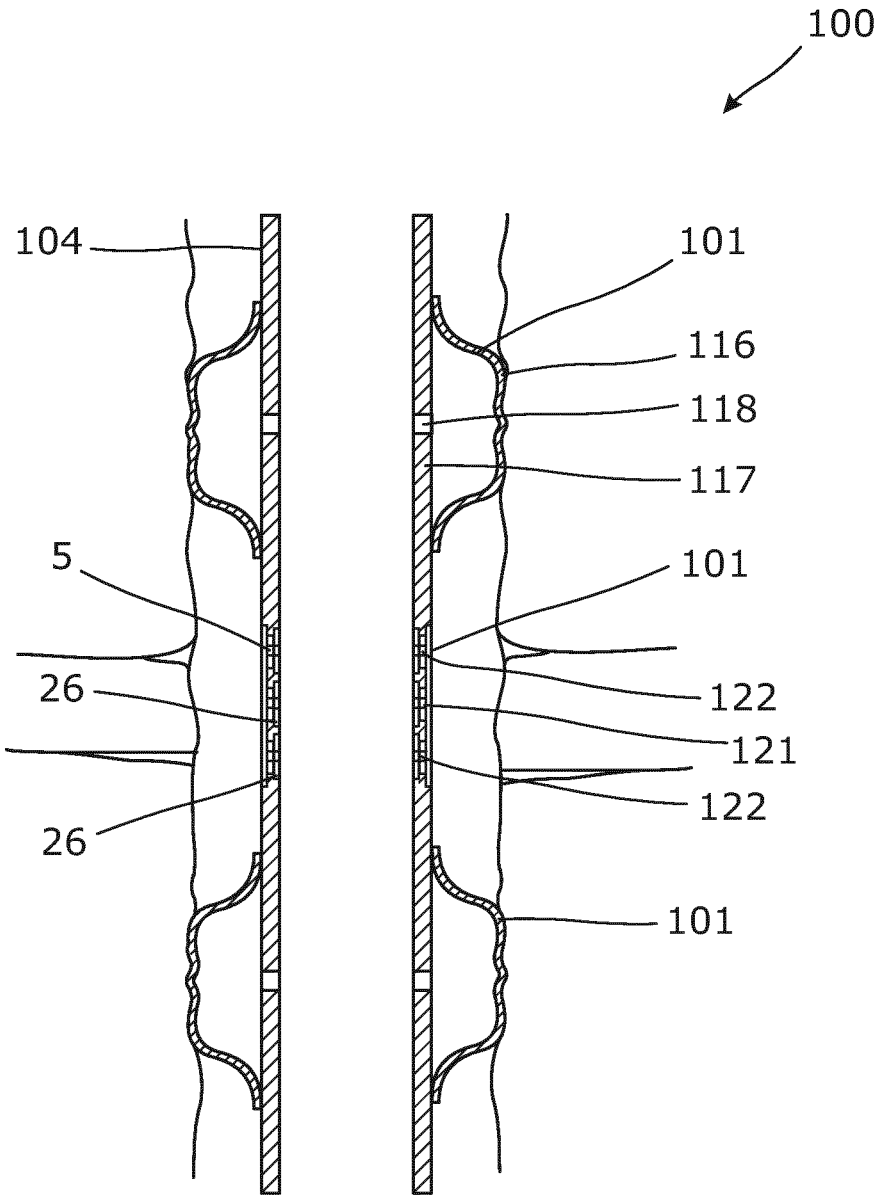
FIG. 9 shows a sectional view of a completion assembly.
Figure 10:
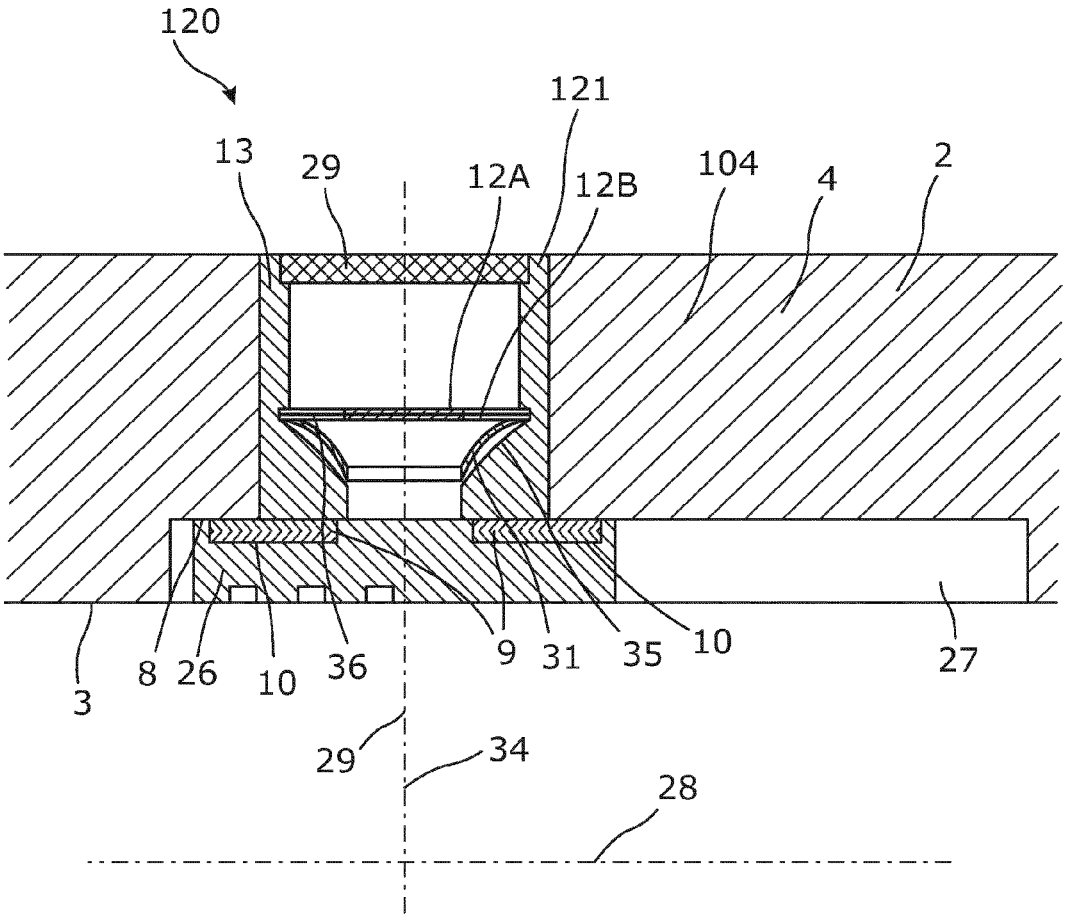
FIG. 10 shows a sectional view of an inflow control section.
Figure 11:
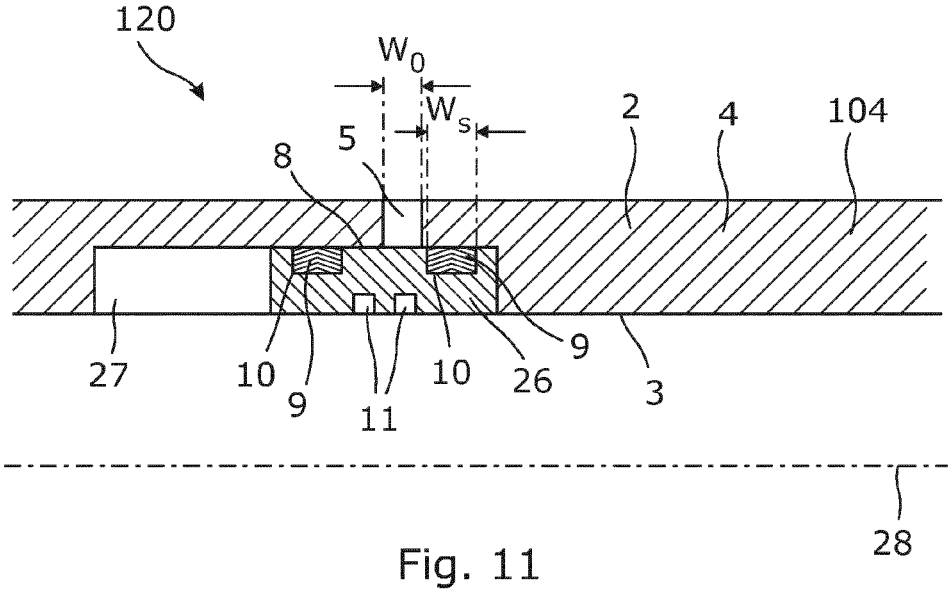
FIG. 11 shows a sliding sleeve in its closed position.

One of the tubular sections 101 of the completion assembly 100 may be an inflow control section 120 or a valve section 120 having valves 121 as shown in FIGS. 8-11. The inflow control section 120 has a tubular part 4 in which an opening 5 is arranged so that fluid can flow from the formation 7 through the opening 5 and into the casing string 104 when producing hydrocarbons. While the casing 104 is pressurised from within, the opening of the inflow control section 120 is sealed off by means of a sliding or rotational sleeve 26. The tubular sleeve 26 has an outer face 8 and is slidable in the axial extension 28 or rotatable circumferentially along the inner face 3. In FIGS. 10 and 11, the sleeve 26 is shown as a sliding sleeve in its second position wherein the fluid is prevented from flowing through the opening. The inflow control section 120 is arranged between the annular barrier sections 110 so that the annular barriers isolate the production zone, and oil from the formation 7 can flow in through the inflow control section 120. In the following description, for the purpose of simplicity, the sleeve is described as a sliding sleeve, but the sliding sleeve may easily be replaced by a rotational sleeve.

By having sliding sleeves 26 capable of closing the valve or inflow control section 120, and thus preventing the pressurised fluid within the casing string 104 from flowing out through the valve or inflow control valve 121 or opening, the expandable sleeves 116 can be expanded during operation even though the casing string 104 comprises inflow control valves 121 or openings in the valve or inflow control section 120.

The sliding sleeve 26 further comprises a sealing element 9 arranged in connection with the sleeve in circumferential grooves 10 at the outer face 8. As can been seen from FIG. 11, the opening 5 have a width in the axial extension 28 of the tubular part 4 and the sealing element 9 has a width being larger than the width of the opening 5. The sealing element width being larger than the width of the opening causes the sealing element 9 not to get stuck when the sliding sleeve 26 passes the opening 5.

The sliding sleeve 26 has an inner face and indentations in the inner face in order that the sleeve can be moved in the recess 27 by a key tool extending into the indentations, forcing the sleeve to slide axially along the inner face of the recess 27. The sealing elements 9 are arranged at a mutual axial distance which is larger than the width of the opening so that the seal in the second position is arranged on opposite sides of the opening, thereby sealing the opening. The sealing element is a chevron seal.

The sliding sleeve 26 is shown in its closed position preventing the flow of fluid from an inflow control valve 121 in the opening from flowing into the casing, but also preventing the fluid in the casing from escaping through the inflow control valve 121. The sliding sleeves 26 are arranged opposite the valves and slidable from an open position to a closed position so that the sleeves slide back and forth in recesses 27 in the wall of the casing and form part of the wall thickness.

When having a slidable sleeve 26 opposite the valve or opening as part of the casing wall, the sliding sleeve 26 can be closed when pressurising the casing 4 from within in order to perform an operation requiring high pressurised fluid, such as when expanding annular barriers. When the operation requiring high pressure is finalised, the sliding sleeve 26 can be opened, and fluid from the annulus can flow into the casing through the valve.

As shown in FIG. 10, the valve section 120 comprises an inflow control valve 121 arranged in the opening 5 of the tubular part 4. The inflow control valve 121 may be any kind of flow restriction, such as a throttle, a constant flow valve, variable choke, steam or fraction valve. In FIG. 10, the inflow control valve 121 is a constant flow valve having a diaphragm 12A, 12B acting towards seat 35 and the membrane 31 in order to control the flow through a screen 29 and out into the casing string 104 if the flow is not prevented by the sliding sleeve 26.

One sliding sleeve may seal off several openings and/or inflow control devices. The openings may be arranged along both the circumferential direction and the axial direction of the casing string.

In FIG. 9, a casing string part is shown having three tubular sections 101. A valve or inflow control section 120 is also arranged between two barrier sections so that the annular barriers isolate a production zone and the well fluid is let into the casing string 104 through the valve or inflow control section 120. The valve or inflow control section 120 has a fracturing valve 122 which is opened or in a choked position by sliding the sliding sleeve 26 when the casing string 104 has been pressurised from within and the formation 7 is fractured by the pressurised fluid. Subsequently, the sliding sleeve 122 may be closed again, and another sleeve 26 is moved to open an inflow control valve 121.

Figure 12:
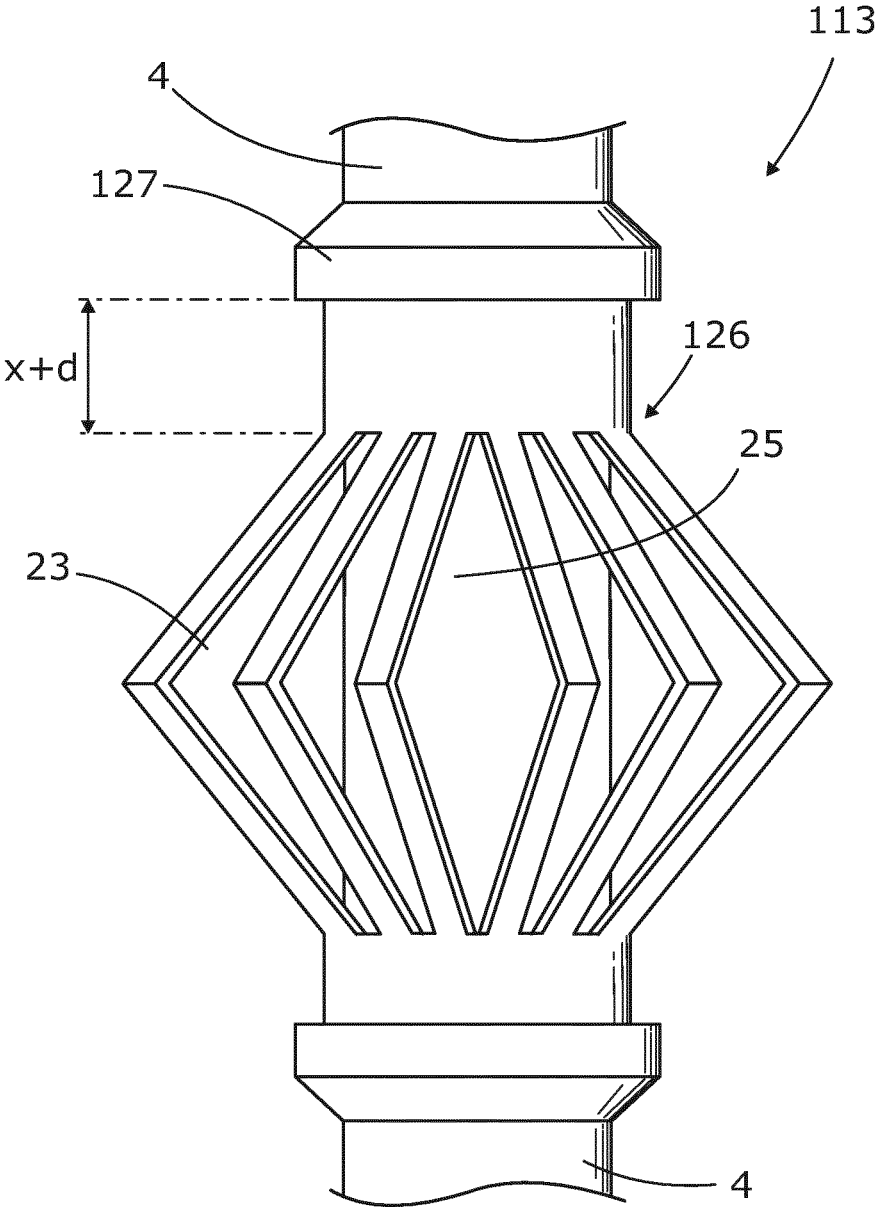
FIG. 12 shows a fixation device.

FIG. 12 shows a tubular section 101 comprising a fixation device 113 and shows the fixation device 113 in an activated position. The fixation device 113 comprises a tubular part 4 having a hollow interior. The tubular part 4 extends in an axial direction and has an exterior surface defining a periphery of the fixation device 113. The fixation device 113 further comprises a fixation unit which is activated, whereby the fixation unit projects in a radial direction in relation to the tubular part 4. When the fixation unit is projected, the fixation device 113 can hold the load of the casing string 104.

The fixation unit of fixation device 113 comprises a first end and a second end which can be moved in relation to one another. During activation of the fixation device 113, the fixation unit is projected by moving the first end a distance "d" towards the second end which is fixed relative to the tubular part 4.

In FIG. 12, the fixation unit of fixation device 113 is shown comprising a slotted liner 126 surrounding the tubular part 4. The slotted liner 126 has a first end and a second end. The slotted liner 126 comprises a plurality of slots 25 forming members 23 connecting the first and second ends. The protrusion 127 adjacent to the first end of the fixation unit has a hollow interior into which the end of the fixation unit extends. The first end of the slotted liner 126 is arranged inside the interior of the protrusion 127 and is formed as a piston. The second end is secured in a recess 27 formed by an edge in the other protrusion 127. Alternatively, the second end may be fixed to the tubular part 4 by welding or in any other way deemed suitable by a person skilled in the art. The interior of the protrusion 127, wherein the first end of the fixation unit or slotted liner 126 is arranged, constitutes a fluid passage between the hollow interior of the tubular part 4 and the end of the slotted liner 126. When the fixation device 113 is activated by pressurising a fluid in the interior of the tubular part 4, the fluid is pushed through the fluid passage, thereby exerting a force on a surface of the first end of the slotted liner 126. This force is directed into the members 23, whereby the members 23 project and the fixation unit enters into the set position.

Figure 12A:
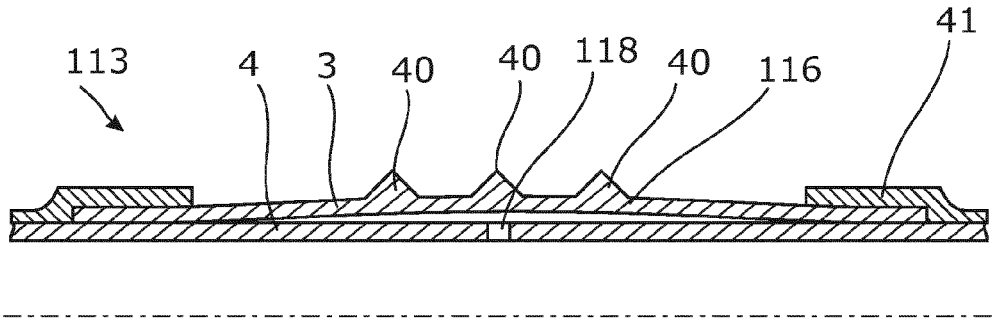
FIGS. 12*a* and 12*b* show another fixation device.
Figure 12B:
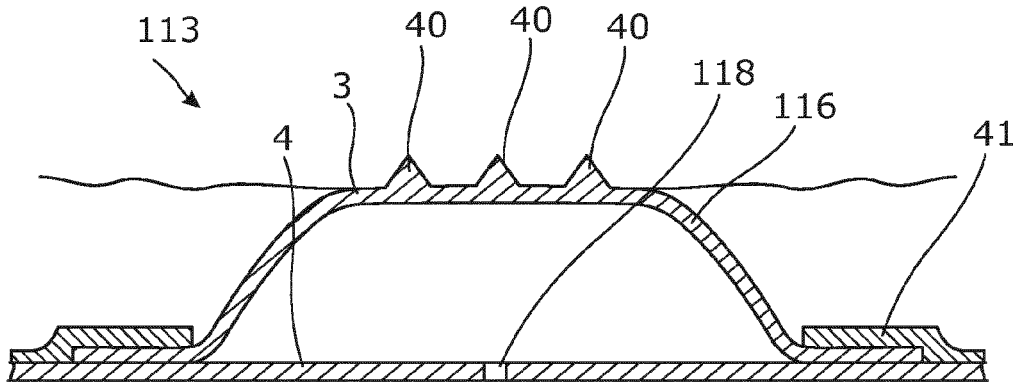

In FIG. 12*a*, a cross-sectional view of another fixation device 113 is shown in its activated position. In FIG. 12*a*, the fixation device 113 comprises an annular barrier 3 having three fixation elements 40 projecting from the expandable sleeve 116 towards the formation 7 when activated by a fluid pressure entering an opening 118 from within the casing string. The expandable sleeve is, at its ends, fastened to the tubular part 4, 117 by means of connection elements 41. As can be seen from FIG. 12*b*, the fixation elements 40 enter the formation 7 and in this way fasten the casing string in the axial direction of the casing string.

Figure 13:
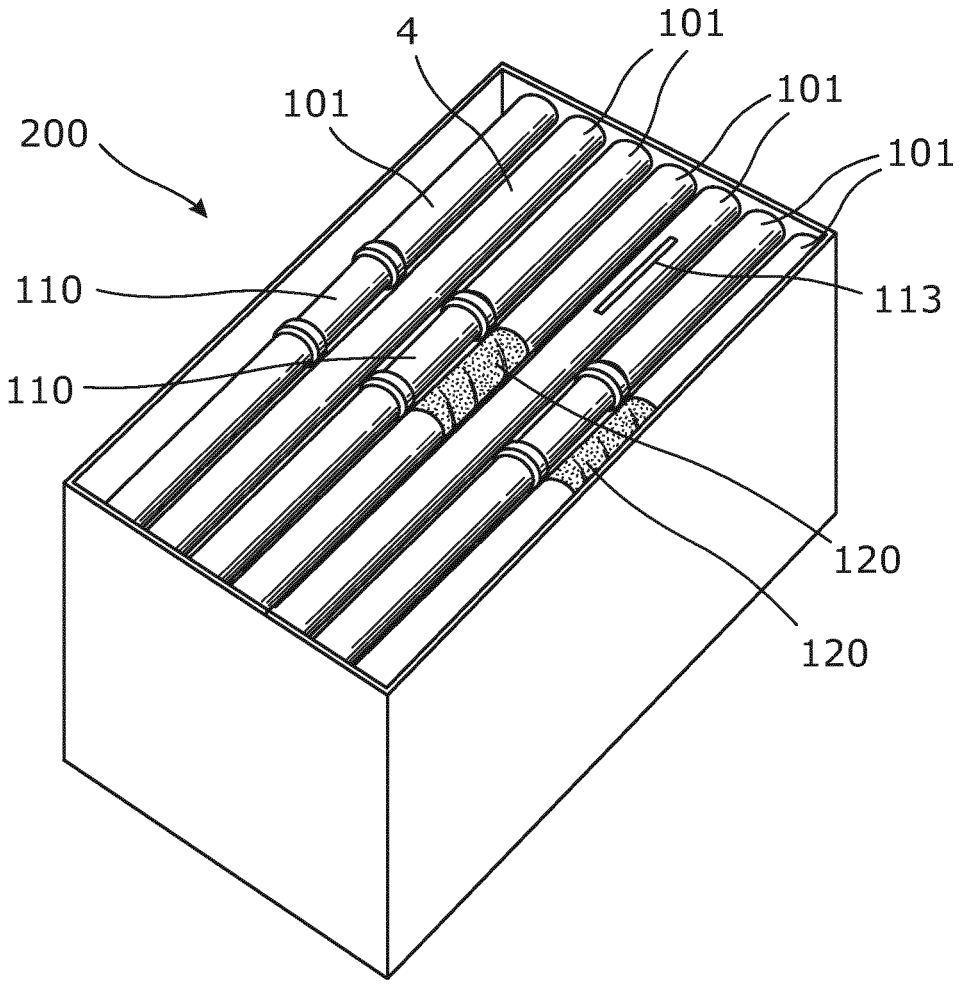
FIG. 13 shows a completion kit.
Figure 13A:
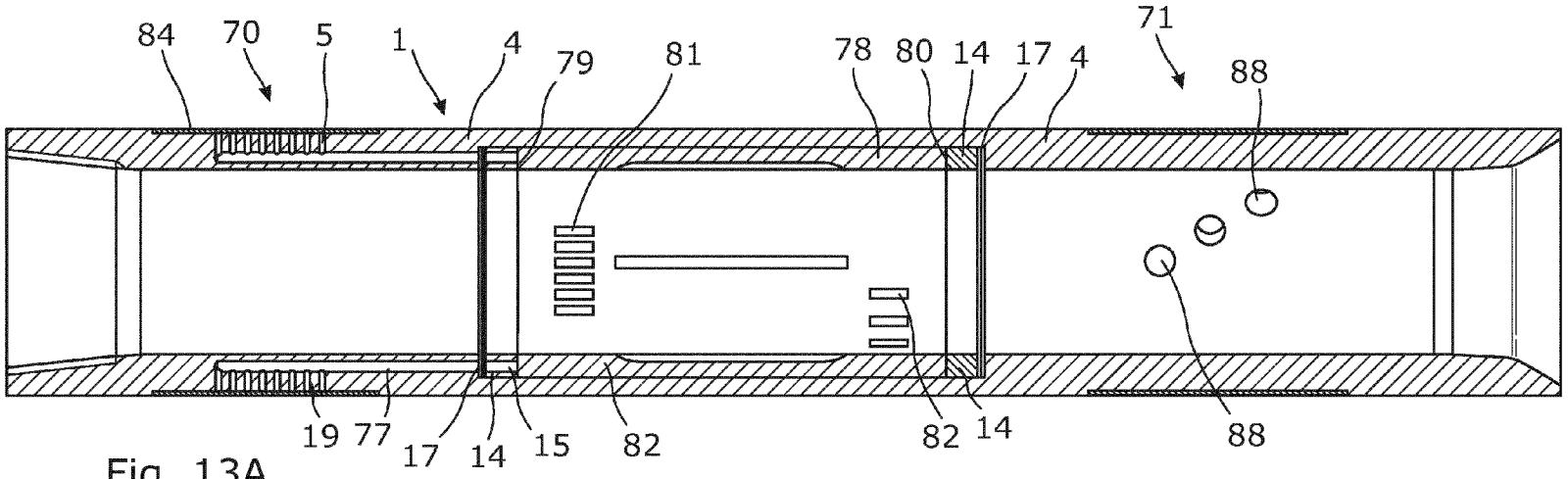
FIGS. 13A and 13B show two longitudinal cross-sectional views of an inflow control section 120.
Figure 13B:
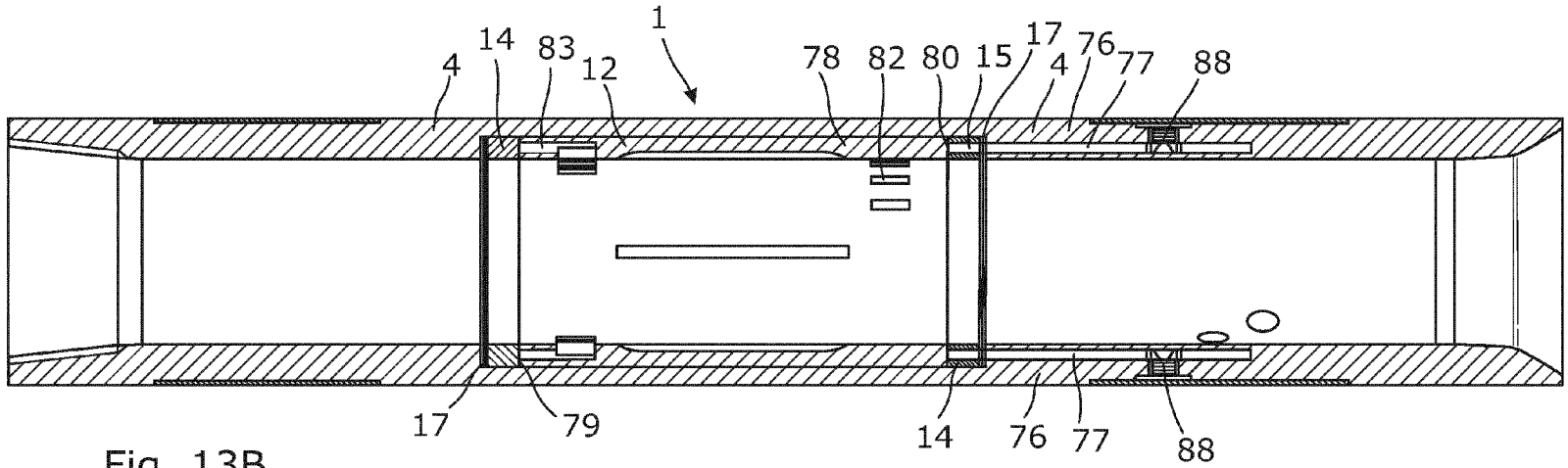

In FIGS. 13A and 13B, the inflow control section 120 in the form of a multi-function sleeve is shown having two inflow parts 70, 71 in a first tubular part 4. In between the inflow parts, a second tubular 78 in the form of a rotational sleeve is arranged controlling the inflow from both inflow parts 70, 71. The inflow control section 120 comprises a first tubular 4 having twelve inlets 5 and a first wall 76 having twelve first axial channels 77 extending in the first wall 76 from the inlets 5. By axial channels is meant that the channels extend in an axial direction in relation to the inflow control section 120. The second tubular 78 has a first end 79 and a second end 80 and twelve outlets 81—only six are shown in FIG. 13A. The second tubular 78 is rotatable within the first tubular 4 and has a second wall 82 with twelve second axial channels 83 (only two are shown) extending in the second wall 82 from the first end 79 to the outlet 81. Thus, each outlet has its own second axial channel.

The second tubular 78 is rotatable in relation to the first tubular 4 at least between a first position, in which the first channel 77 and second channel are in alignment for allowing fluid to flow from the reservoir into the casing via the first end 79 of the second tubular 78 and a second position in which the first channel 77 and second channel are out of alignment so that fluid is prevented from flowing into the casing.

The inflow control section 120 also comprises a first packer 14 which is arranged between the first tubular 4 and the first end 79 of the second tubular 78. The packer 14 extends around the inner circumferential recess. The packer 14 has the same number of through-going packer channels 15 as there are first axial channels, i.e. in this embodiment twelve, the packer channels 15 being aligned with the first axial channels 77.

The packer 14 is preferably made of ceramics, whereby it is possible to make the contact surfaces of the packer 14 smooth, which enhances the sealing properties of the packer 14, since the smooth contact surface may be pressed closer to the opposite surface, for instance the first end 79 of the second tubular 78. However, in other embodiments, the packer may be made of metal, composites, polymers, or the like. Spring elements 17 are arranged between the packer 14 and the tubular 4 to press the packer towards the second tubular or rotational sleeve 78. The packer channels 15 are positioned in the same manner as the two groups of inlets as described. The spring element 17 is positioned between the wall 76 of the first tubular 4 and the packer 14. The spring element 17 is placed in the same inner circumferential recess 13 as the packer 14 and the second tubular. The spring element 17 is bellows-shaped and is preferably made of metal. The bellows-shaped spring element 17 comprises axial grooves, in which the fluid flow can force the spring element 17 against the packer 14, whereby the fluid flow and pressure exert an axial force on the packer 14 so that the packer is pressed against the second tubular, providing enhanced sealing properties.

Furthermore, the second tubular 8 comprises at least one recess 18 accessible from within, the recess 18 being adapted to receive a key tool (not shown) for rotating the second tubular 8 in relation to the first tubular 4.

In FIGS. 13A and 13B, flow restrictors 19 are arranged in the inlets 5 for restricting or throttle the inflow of fluid into the first channels 77. The flow restrictors 19 may be any kind of suitable valves, such as a constant flow valve 88 shown at the right inflow part 71.

Furthermore, a screen 84 is arranged around the inlets 5 for protecting the inlets 5, as well as the flow restrictors and valves arranged in the inlets, when the inflow assembly is not in operation.

In addition to these features, the inflow control section also comprises a third tubular, which is rotatable within the first tubular 4. The third tubular 38 which is rotatable may for instance be a fracturing port or a rotational fracturing sleeve.

In the shown valve or inflow control section 120, in which the packers 14 and the spring elements 17 are arranged on both sides of the second tubular 78, the fluid flowing in the axial channels on both sides of the second tubular will exert axial forces on both sides of the second tubular 78, i.e. on the spring elements 17 and thereby on the packers 14. Hereby, enhanced sealing properties are provided on both sides of the second tubular 78. Even when the second tubular 78 is in a closed position (as shown in FIGS. 13A and 13B) at one end or both ends, the fluid flowing in through the inlets will still exert axial forces via the spring elements and the packers towards the second tubular 78. Thus, when the axial channels arranged at each end of the second tubular 78 are all in non-alignment with the axial channels of the first tubular, the fluid is at least stopped from flowing into the casing at these points. However, since the fluid at both ends of the second tubular still has a flow pressure which is almost equal to the formation pressure, the fluid pressure will exert axial force at both ends of the second tubular, and will consequently force the packers towards the ends of the second tubular 78, whereby the inflow control section has an enhanced sealing around the second tubular 78, even when the flow of fluid has been stopped.

One or more of the tubular sections 101 may also be a tubular section/tubular sections containing only a tubular part without any annular barriers, fixation devices or inflow control valves or openings.

The annular barrier comprises a valve arranged in the opening 5 of the tubular part 4.

The completion assembly 100 may comprise closing means for closing the second end 111 of the casing string 104. The closing means may be a ball dropped into a seat in the second end 111 of the casing string 104.

As shown in FIG. 13, the invention also relates to a completion kit 200 for completing a casing string 104 of the aforementioned completion assembly 100. The completion kit 200 comprises a container 201 comprising a plurality of tubular sections 101 in the form of annular barrier sections 110, and a plurality of tubular sections 101 in the form of inflow control sections 120. Furthermore, the container comprises at least one fixation device 113 and a plurality of tubular sections 101 containing only a tubular part 4. All the tubular sections 101 are sorted in the container in the order needed when mounting the tubular sections 101 into one casing string 104. The container 201 is thus arranged to comprise all the tubular sections 101 needed to make the entire casing string 104 to be connected to the drill pipe 102 and submerged into the borehole 6. The container 201 has a conventional size and can be carried to the drilling rig by means of a vessel so that the drilling rig can be transported directly to the site where a well is to be completed. Thus, time and money are saved because the drilling rig does not have to be transported to a harbour to get the tubular sections 101 on board. Instead it can be transported directly to the next site at which a well is to be made.

The tubular sections of the kit are designed in length to fit a standard container and to fit a standard mounting arrangement on the rig, so that the tubular sections can be transported by any suitable means for transporting a container and so that the tubular sections can be assembled into one casing string in a conventional mounting equipment on board a rig or vessel.

By casing pressure is meant the pressure of the fluid which is present in the casing when the casing string 104 is pressurised by means of the pressure creating device 119. By formation fluid pressure is meant the fluid pressure which is present in the formation 7 outside the casing string 104 in the annulus surrounding the string in the borehole 6.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production. By casing string is thus also meant a liner string.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A completion assembly for running into a borehole in a formation, comprising:

a casing string having a first end and a second end, and a drill pipe removably connected at a first end with the casing string at the first end of the casing string, wherein the casing string comprises:

a plurality of tubular sections, at least two sections being annular barrier sections each comprising at least one annular barrier, the annular barriers being arranged at a predetermined mutual distance, each annular barrier comprising an expandable sleeve surrounding a tubular part, the tubular part forming part of the casing string and having an opening for entry of pressurised fluid to expand the sleeve, and a second closed end, and the assembly comprises a pressure creating device connected with a second end of the drill pipe, and configured to generate a casing fluid pressure within the drill pipe and within the casing string sufficient to expand each expandable sleeve, which casing fluid pressure is substantially greater than a formation fluid pressure in order to expand each expandable sleeve while in the borehole, after which the drill pipe is disconnected from the casing string.

2. A completion assembly according to claim 1, wherein one of the tubular sections is an inflow control section having a tubular part.

3. A completion assembly according to claim 2, wherein the inflow control section is arranged between the annular barrier sections.

4. A completion assembly according to claim 2, wherein the inflow control section comprises an inflow control valve arranged in the tubular part.

5. A completion assembly according to claim 2, wherein the inflow control section comprises a fracturing sleeve slidable between an open position opposite a fracturing opening and a closed position.

6. A completion assembly according to claim 2, furthing comprising a sliding sleeve slidable axially to the casing string opposite the inflow control section to seal off the inflow control section when the expandable sleeves are expanded.

7. A completion assembly according to claim 6, wherein the tubular part has an inner face and the sliding sleeve has an outer face facing the inner face of the tubular part, and the sliding sleeve comprises sealing elements arranged in grooves in the outer face of the sliding sleeve.

8. A completion assembly according to claim 1, wherein one of the tubular sections is a section containing only the tubular part.

9. A completion assembly according to claim 1, wherein one of the tubular sections comprises a fixation device to anchor the casing string to the formation.

10. A completion method for completing a casing string according to claim 1, comprising the steps of:

mounting tubular sections into a first part of the casing string, lowering the first part of the casing string, mounting tubular sections into a second part of the casing string, connecting the second part of the casing string with the first part, lowering the second part of the casing along with the first part, connecting a drill pipe to the casing string, wherein the casing string comprises at least two annular barrier sections, lowering the drill pipe into the borehole until the casing string is arranged in a predetermined position, pressurising the drill pipe and the casing string, and simultaneously expanding an expandable sleeve of an annular barrier of each of the annular barrier sections.

11. A completion method according to claim 10, furthing comprising the step of disconnecting the drill pipe.

12. A completion method according to claim 10, furthering comprising the step of connecting an inflow control section to the casing string.

13. A completion method according to claim 10, further comprising the steps of connecting a fixation device to the casing string and activating the fixation device substantially simultaneously with the step of expanding the expandable sleeve.

14. A completion method according to claim 10, furthering comprising the steps of opening a fracturing sleeve, and fracturing the formation by means of a pressurised fluid from within the casing string in order to make fractures in the formation.

15. A completion kit for making a completion assembly according to claim 1, comprising a container comprising:

the plurality of annular barrier sections, and a plurality of inflow control sections.

16. A completion kit according to claim 15, wherein the container comprises at least one fixation device.

17. A completion kit according to claim 15, wherein the container comprises a plurality of tubular sections containing only a tubular part.

* * * * *